US008334775B2

(12) United States Patent
Tapp et al.

(10) Patent No.: US 8,334,775 B2
(45) Date of Patent: Dec. 18, 2012

(54) RFID-BASED ASSET SECURITY AND TRACKING SYSTEM, APPARATUS AND METHOD

(75) Inventors: Hollis M. Tapp, Mesquite, TX (US); Joseph C. McAlexander, Murphy, TX (US); James Olivier, Dallas, TX (US); William C. Slemmer, Frisco, TX (US)

(73) Assignee: Guardian Technologies, Dallas, TX (US)

( * ) Notice: Subject to any disclaimer, the term of this patent is extended or adjusted under 35 U.S.C. 154(b) by 501 days.

(21) Appl. No.: 12/470,709

(22) Filed: May 22, 2009

(65) Prior Publication Data

US 2009/0322537 A1 Dec. 31, 2009

Related U.S. Application Data

(60) Provisional application No. 61/128,736, filed on May 23, 2008.

(51) Int. Cl.
*G08B 13/14* (2006.01)

(52) U.S. Cl. ..... 340/572.4; 235/375

(58) Field of Classification Search ..... 340/572.4; 235/375; 455/456.1

See application file for complete search history.

(56) References Cited

U.S. PATENT DOCUMENTS 5,745,036 A * 4/1998 Clare ..... 235/375
7,631,808 B2 * 12/2009 Kundu et al. ..... 235/375
7,920,626 B2 * 4/2011 Fernandez et al. ..... 375/240.16

* cited by examiner

*Primary Examiner* — John A Tweel, Jr.

(57) ABSTRACT

Systems and methods are disclosed for tracking an item using a RFID surveillance system. In some embodiments, a security controller is connected to a point of sale system with at least one RFID tag reader. In these embodiments, the RFID tag reader is associated with an area that is observable through a video camera. If the tag reader does not recognize information obtained from a RFID tag, the tag reader may activate the video camera. When the video camera is activated, the video camera may capture images and send them to a recording device.

4 Claims, 2 Drawing Sheets

RFID-BASED ASSET SECURITY AND TRACKING SYSTEM, APPARATUS AND METHOD

PRIORITY CLAIM TO PROVISIONAL PATENT APPLICATION

This patent application claims priority to U.S. Provisional Patent Application Ser. No. 61/128,736 filed on May 23, 2008.

TECHNICAL FIELD

The present invention relates generally to radio frequency identification, and more particularly to an asset control and security system for tracking items leaving one location or area.

BACKGROUND

Prior art tracking systems use passive tags (e.g. RFID tags) attached to an item, such as a single item, a lot, or container holding multiple units. A remote station scans or communicates (using radio frequency or other wireless communications method) with the tag generally when the item enters a certain location. This allows the item to be uniquely identified as being present at one location or another.

However, such systems typically only track items within a specific facility for purposes of determining the presence or absence at a given location, thus tracking of inventory and parts for production purposes. None of these systems focuses on security issues, such as the unauthorized movement of an item from a certain area or location. Further, none of these systems provides further tracking of a device after exiting a facility.

Accordingly, there is needed a security system based on RFID tracking to provide control and security for assets.

BRIEF DESCRIPTION OF THE DRAWINGS

For a more complete understanding of the present invention, and the advantages thereof, reference is now made to the following descriptions taken in conjunction with the accompanying drawings, wherein like numbers designate like objects, and in which.

DETAILED DESCRIPTION

Figure 1:
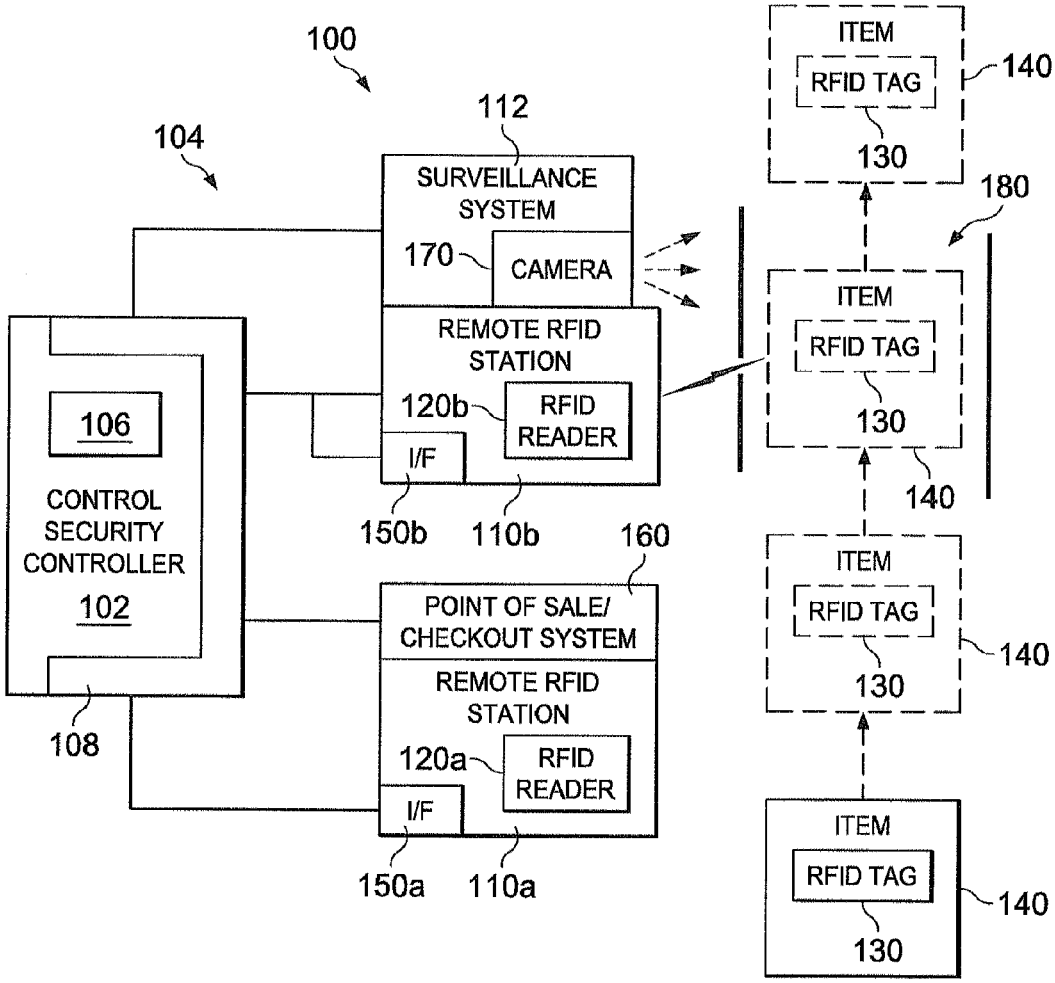
FIG. 1 illustrates an example RFID tracking system and apparatus in accordance with the present disclosure.

FIG. 1 illustrates an example security system 100 in accordance with one embodiment of the present disclosure. Other embodiments and configurations of the system 100 may be used without departing from the scope of this disclosure. This security system is illustrated, and will be described with respect to, a retail store operation. The security system 100 shown in FIG. 1 may be used for other purposes and applications and within different environments, such as distribution or manufacturing.

In this one embodiment, the security system 100 includes a central security controller 102 operatively and communicatively coupled via a data network 104 to a plurality of remote RFID stations 110. The central security controller 102 may be configured to include one or more computer systems, servers or other processing means for transmitting/receiving data to/from the remote RFID stations 110 and a surveillance system 112 in the system 100. The data network 104 may be any type of network suitable to provide communications (wireless, wireline or combination thereof) between the devices. As will be appreciated, additional remote RFID stations 110 and surveillance devices may be included.

The central security controller 102 generally includes a number of components or devices (not shown), including one or more processors, firmware and/or software, and input/output device(s) (such as a display and keyboard), not shown, as well as memory (that may be in the form of a database) 106 and a network interface 108 for interfacing with the data network 104.

Each remote RFID station 110 includes conventional and known electronic circuitry and other structural components. Each remote RFID station 110 includes an RFID tag reader 120 operable for communicating with an RFID (transponder) tag 130 associated with an item 140 to be tracked or monitored. As will be appreciated, the RFID tag 130 is usually physically attached to the item 140. Network interface circuitry 150 interfaces the remote RFID station 110 with the data network 104 enabling communication between remote RFID stations 110 and the central security controller 102. The remote RFID stations 110 may optionally include proximity sensors (if proximity-triggered tag reading as opposed to continuous tag reading is desired).

Item 140 may be any device, article or package, and in the retail store operations embodiment shown and described herein, the item 140 is generally an item that is being purchased by a customer. The remote RFID station 110*a* forms part of a point-of-sale (POS) or sales checkout system 160. The system 160 may include multiple checkout "lanes" and remote RFID stations 110*a*. In conventional retail store operations, a customer takes the item 140 to the POS 160 and the item 140 is scanned and purchased. At (or near) the POS 160, the RFID tag reader 120*a* performs an RFID tag read process after the item 140 is scanned in a conventional POS process. This may be accomplished by locating the RFID tag reader 120*a* towards the end of the POS station 160 (i.e., after the item is scanned). The RFID tag 130 associated with the item 140 is polled and read. Upon completion of the tag read process, RFID tag information is transmitted to the central security controller 102. This RFID tag information typically uniquely identifies the item 140.

The RFID tag 130 is activated by a wireless transmission emitted by the RFID reader 120 and in response relays, conveys or communicates identification information back to the RFID reader 120. Operation of RFID tags 130 and RFID tag readers 120 is well-known to those skilled in the art and no further detailed description of their operation is provided except as necessary to understand the present disclosure. For example, the RFID tag reader 120 may transmit a low power, low frequency signal that energizes the RFID tag 130. This signal provides sufficient energy to the RFID tag 130 enabling the RFID tag 130 to respond with another low power, low frequency signal carrying a unique serial or identification number (or other data) of the RFID tag 130. This number identifies the item 140.

The RFID tag readers 120 and the RFID tags 130 may be any devices providing the functionality described herein. Suitable devices may include one or more of the RFID readers (or modules) and RFID (transponders) tags currently available from various manufacturers, including Texas Instruments, Inc.

In another embodiment, the RFID reader 120 may operate in conjunction with the POS 160 by holding or delaying transmission of the read RFID tag information until payment for the item 140 has been made. Further, for reliability purposes, the list of items 140 scanned by the POS 160 may be correlated (e.g., number of items POS-scanned compared to the number of RFID tags read from those items 140).

Upon receipt of the transmitted RFID tag information, the central security controller 102 stores the RFID tag information for comparison with RFID tag information generated by the RFID tag reader 120*b* as described in more detail hereafter. The RFID tag information can be cross-referenced within a database or other data structure maintained by the security central controller 102 or one of its components. This can be used to track or monitor items 140.

The RFID tag reader 120*b* is positioned at a location remote from the RFID tag reader 120*a*, and in one embodiment is located at the facility's (e.g., store's) exit/entrance for customers. The remote RFID station 110*a* may be standalone or may form part of the surveillance system 112.

As the purchased item 140 moves into the proximity zone of the RFID tag reader 120*b*, the reader performs an RFID tag read process on the RFID tag 130 (e.g., as the customer exits the facility). The RFID tag 130 associated with the item 140 is polled and read. Upon completion of the tag read process, the RFID tag information is transmitted to the central security controller 102.

After receiving the RFID tag information transmitted from the RFID reader 120*b*, the central security controller 102 compares this RFID tag information with stored RFID tag information received from RFID reader 120*a*. If there is a match, the controller 102 determines the item 140 exiting the facility is authorized (e.g., proper payment received). In the event no corresponding RFID tag information was previously stored, then the controller 102 determines the item 140 exiting the facility is unauthorized (e.g., no payment received).

When an item 140 exiting the facility is unauthorized, the security central controller 102 may store the RFID information from that item (for further analysis and reporting) or initiate other surveillance or notification action to be performed by the surveillance system 112. For example, a video surveillance camera 170 capable of viewing the exit/entrance area may be activated and capture and record still or motion video. The recorded images may be in any suitable or conventional format. If positioned appropriately, the recorded video should also capture video of the actual unauthorized item 140 and/or a person carrying the unauthorized item 140 through the exit area 180. In addition, the surveillance system 112 may further provide a mechanism or method for notifying facility employees or others of the event. Thus, the surveillance system 112 may include one or more displays, alarms and/or audio devices, and may further include communication means for communication to remote mobile devices (e.g., radios, pagers, PDAs, cell phones, etc.). The surveillance system 112 will typically include other electronic devices (not shown), such as a controller and/or network interface, for providing the functionality and capabilities as described herein.

In another embodiment, the camera 170 in the system 100 is structured and programmed/activated to capture video of item 140 directly in response to RFID tag read/detection performed by the remote RFID station 120*b* as the item 140 travels into or through the designated area 180. The recorded video and RFID tag information is stored in a memory (not shown) within the system 112 or may be transmitted and stored at the controller 102. This information can be saved for later uses. In addition, the above-described video activation and recording system which is initiated or triggered in response to RFID tag detection may be configured or positioned to view any area(s), as desired. In basic terms, the system records video of the item 140 when its RFID tag is detected and read. Multiple video recording devices and remote stations may be included in the system 100.

In yet another embodiment, in addition to passive reading of RFID tags, the RFID reader 120*a* associated with the POS 160 includes the ability to transmit authorization data (e.g., one or more data bits) to the detected RFID tag 130. This data is stored in the RFID tag 130, and may be stored in a specific memory location therein. In this manner, it would not be necessary to transmit the RFID tag information procured by the RFID reader 120*a* to the controller 102. At the exit area 180, the RFID reader 120*b* would be programmed to read the basic RFID tag information, as well as the authorization data stored in the specific memory location, in the RFID tag 130. If the authorization data is not present, the RFID tag information may be stored and the surveillance system 112 activated because of the unauthorized movement through the exit area 180.

The present disclosure is also directed to "stealth"RFID tags. These may be associated with or affixed to any object, such as an article or a person. Using portions of the system of FIG. 1, this stealth system operates to deactivate continuous surveillance of an area, in contrast to activating surveillance when triggered. For example, as the object 140 enters the designated area 180, the RFID reader 120*b* performs the conventional read process. Upon receipt of the RFID tag information, it is compared to a known list of RFID tags subject to "stealth" activities. This is accomplished by a stealth activation component (e.g., RFID station 110*b* itself or the controller 102). If there is a match, the surveillance system 112 is deactivated. For example, if the area 180 is continuously being monitored by the video camera 170, the camera 170 is deactivated for a period of time or until the object 140 reaches an adjacent area having another RFID station 110 which detects the object 140. Once detected, the system may signal that the camera 170 may be turned back on. In other words, the "stealth" RFID tag deactivates recording of a specific area when present in the area. As will be appreciated, the stealth tag may not be limited to conventional RFID tags, but may be implemented using any similar detectable device. In addition, such stealth tag may also include its own powered transmitter that does not require activation by a remote reader device.

In another embodiment directed to inventory control, an inventory control system may include the RFID remote station 110*b* associated with the area 180 for detecting and controlling inventory that flows through area 180. The system generally includes the central controller 102 integrated with a purchasing or ordering system (not shown) similar to the POS 160, however, the purchasing and ordering system does not necessarily operate upon physical items brought to the POS for purchase. It may include a purchasing system coupled to one or more terminals and or the internet for receiving and logging purchases of a system or product having several components.

As an example, assuming an item or product being purchased includes five different components, and each component (e.g., asset) has associated therewith an RFID tag 130. When the product is ordered, in a warehouse or other facility, each of the components should be delivered through the area 180 to be assembled into or shipped to another area (within or without the warehouse or facility) or to the customer. As the components enter or pass through the area 180, their respective RFID tags are read and the RFID tag information is transmitted to the controller 102. Within the controller 102 there exists stored information identifying the product as being composed of the five separate components (and what RFID tag information should be associated with each component). In the event only one or some of the components (not all of the components) are detected in area 180 within a period of time for delivery, the controller 102 triggers or activates an alarm or takes some other action (initiates an action to be performed by devices or processes within the surveillance system 112).

Additionally, for any embodiments, other specific actions or activities performed by the controller 102 as result of event detection, RFID reads, and receipt of RFID tag data read in response to the event detections will be not be described herein in detail. Those of ordinary skill in the art will be able to utilize such information for various purposes, but mainly to assist in the monitoring and tracking of items throughout the process to increase efficiency, reduce errors, etc.

Figure 2:
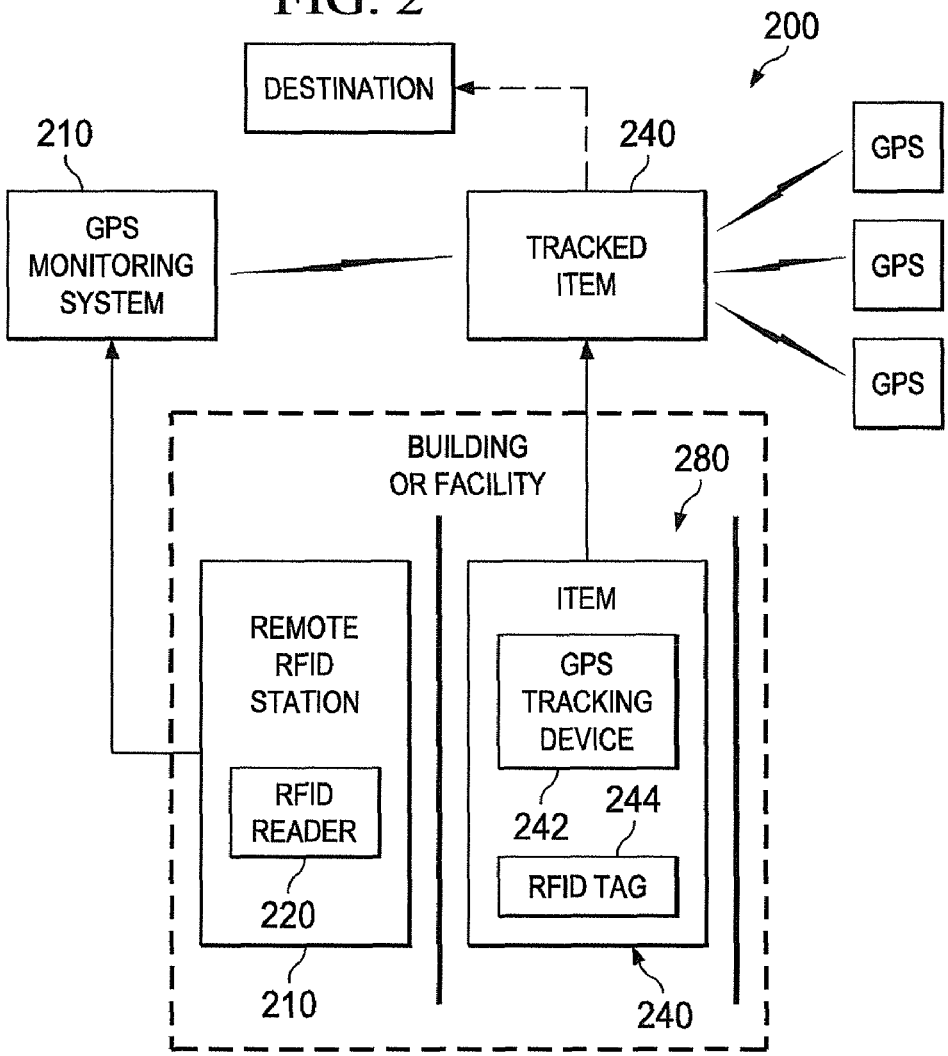
FIG. 2 illustrates an RFID-based GPS monitoring system and apparatus.

Now turning to FIG. 2, there is illustrated a RFID-based GPS tracking system 200 that integrates RFID-based detection and monitoring devices (RFID tags, RFID readers) into a conventional GPS tracking system. Utilization of RFID components in the system 200 allows automatic activation (or deactivation) of GPS monitoring when a tracked item 240 exits/enters a certain area. Item 240 includes a GPS tracking device 242, which typically includes a GPS receiver and a wireless transmitter, for providing GPS tracking functions. As is known, the GPS tracking device 242 communicates GPS location information (generated from GPS satellite transmissions) to a GPS monitoring system 210 within the system 200. This provides conventional GPS tracking of item 240.

The GPS monitoring system 210 may include any number of components or devices (not shown), including one or more processors, firmware and/or software, transmitters, receivers, network interfaces and input/output device(s) (such as a display and keyboard), as well as memory. The system 210 may communicate with GPS tracking device 242 and RFID remote station 220 via any existing communications network or a proprietary communications network.

Item 240 also includes a conventional RFID tag 244. When item 240 enters a certain area 280 (reaches an exit area), an RFID reader 220 associated with area 280 performs a read of RFID tag 244. The interrogated RFID tag information is transmitted to the GPS monitoring system 210 (via wireless or wireline communications using network interface 250) and is used to determine the identity of the GPS tracking device 242 associated with item 240 (this information is pre-stored in memory of system 210). Based thereon, the system 210 transmits data to GPS tracking device 242 to activate its GPS monitoring functions. Thus, the GPS tracking device 242 may remain in a sleep or inactive mode until awakened or activated in response to RFID tag interrogation at a specific location. Through detection of item 240 in area 280 utilizing the RFID tag 244 and RFID reader 220, the system 210 learns that item 240 is leaving the given area 280 and GPS tracking should be initiated.

For example, item 240 may be exiting area 280 within a manufacturing or distribution facility for delivery to a distant location. Based on interrogation/detection at the exit location, the system 200 switches over to GPS tracking using conventional GPS tracking. When item 240 reaches an entrance location of a destination facility, another RFID reader (not shown) detects its arrival and transmits the RFID tag information to the system 210 which, in turn, may deactivate conventional GPS monitoring functions by communicating deactivation instructions to the GPS tracking device 242. Thereafter, the item 240 may be tracked within the destination facility using RFID tracking, if desired.

Conventional GPS monitoring suffers from reduced or nonexistent capabilities when the tracked object enters a building. The above-described system and process provide "visibility" and tracking of the object when conventional GPS is unable to track the object further (within the building). Thus, the system 200 includes two tracking/monitoring subsystems—GPS-based and RFID-based. The system 200 transfers tracking control to the GPS or RFID portions, where appropriate, when the item 240 is inside/outside a given area.

This disclosure is also directed to negative interaction RFID tag operations and systems. These systems utilized RFID tags that each transmit to a central (or zone) processor that determines when two (or more) tags, and hence the objects the tags are affixed to, are in undesirable proximity—and sounds an alarm (or performs other functions). The two (or more) items that should not occupy the same space or come into close proximity.

In addition, there are situations when an object should not be within a certain area for safety reasons. For example, a child's article of clothing (e.g., shoelaces) may include an RFID tag, and when read by one or more RFID tag readers positioned around a swimming pool, will sound an alarm.

It may be advantageous to set forth definitions of certain words and phrases used throughout this patent document. The terms "include" and "comprise," as well as derivatives thereof, mean inclusion without limitation. The term "or" is inclusive, meaning and/or. The phrases "associated with" and "associated therewith," as well as derivatives thereof, mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, whether such a device is implemented in hardware, firmware, software or some combination of at least two of the same. It should be noted that the functionality associated with any particular controller may be centralized or distributed, whether locally or remotely.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A RFID-based surveillance system for tracking an item, the system comprising:

a security controller;

a point of sale (POS) system having a first RFID tag reader associated with a first area, the POS system communicatively coupled to the security controller and operable for reading RFID tag information of an RFID tag associated with the item and transmitting the RFID tag information to the security controller;

a second RFID tag reader associated with a second area, the second RFID tag reader communicatively coupled to the security controller and operable for reading RFID tag information of the RFID tag associated with the item and transmitting the RFID tag information to the security controller;

a video camera communicatively coupled to the security controller operable for capturing one or more images when the RFID tag information received from the second RFID tag reader does not match stored RFID tag information; and a recording device for storing one or more images captured by the video camera.

2. A RFID-based surveillance system for capturing one or more images of an area, the system comprising:

a security controller;

an RFID tag reader associated with an area, the RFID tag reader communicatively coupled to the security controller and operable for reading RFID tag information of an RFID tag associated with an item and transmitting the RFID tag information to the security controller;

a video camera communicatively coupled to the security controller and operable for capturing one or more images and being activated in response to the RFID tag information received at the security controller not matching stored RFID tag information; and a recording device for storing the one or more images captured by the video camera.

3. A method for tracking an item using a RFID-based surveillance system, the method comprising:

reading, by a first RFID tag reader associated with a first area, RFID tag information of an RFID tag associated with the item;

transmitting the RFID tag information read by the first RFID tag reader to a security controller;

reading, by a second RFID tag reader associated with a second area, RFID tag information of the RFID tag associated with the item;

transmitting the RFID tag information read by the second RFID tag reader to the security controller;

capturing one or more images using a video camera when the RFID tag information received from the second RFID tag reader does not match stored RFID tag information; and a recording device for storing the one or more images captured by the video camera.

4. A RFID-based surveillance system for tracking an item, the surveillance system comprising:

a security controller;

a first detection system having a first RFID tag reader associated with a first area, the detection system communicatively coupled to the security controller and operable for reading RFID tag information of an RFID tag associated with the item and transmitting the RFID tag information to the security controller;

a second detection system having a second RFID tag reader associated with a second area, the second RFID tag reader communicatively coupled to the security controller and operable for reading RFID tag information of the RFID tag associated with the item and transmitting the RFID tag information to the security controller; and a video camera communicatively coupled to the security controller and operable for capturing one or more images when the RFID tag information received from the second RFID tag reader does not match stored RFID tag information.

* * * * *